United States Patent [19]

Kuroda

[11] 4,025,993

[45] May 31, 1977

[54] METHOD OF, AND APPARATUS FOR SIZING AND DRYING WARPS

[75] Inventor: Susumu Kuroda, Nagoya, Japan

[73] Assignee: Kawamoto Industrial Co., Limited, Nagoya, Japan

[22] Filed: Mar. 24, 1976

[21] Appl. No.: 669,891

[30] Foreign Application Priority Data

Apr. 12, 1975 Japan ..... 50-44391

[52] U.S. Cl. ..... 28/28; 28/72.6

[51] Int. Cl.² ..... D06C 29/00

[58] Field of Search ..... 28/28, 54, 59, 72.5, 28/72.6; 8/115.6, 18; 34/152; 427/175, 381, 390, 394, 424; 118/78, 234, 325, 420

[56] References Cited

UNITED STATES PATENTS

| | | | |
|---|---|---|---|
| 949,732 | 2/1910 | Morrill | 28/54 X |
| 1,458,473 | 6/1923 | Evans | 28/28 |
| 2,402,653 | 6/1946 | Clark | 28/28 |
| 2,438,084 | 3/1948 | Wood | 28/28 |
| 2,478,230 | 8/1949 | Bouvet | 28/28 |
| 2,565,407 | 8/1951 | Still | 28/28 |
| 3,732,603 | 5/1973 | Iliman et al. | 28/72.6 |

*Primary Examiner*—Louis K. Rimrodt
*Attorney, Agent, or Firm*—Dennison, Dennison, Meserole & Pollack

[57] ABSTRACT

A method of sizing and drying spun yarns intended for use as warps is disclosed. A large number of spun yarns withdrawn from at least one warp beam supported on a beam stand, in spaced relationship in the form of a sheet, are advanced through a solution of size and squeezed in a sizing section, so that size is uniformly applied to the yarns. The yarns thus sized are rubbed against rods and comb needles having surfaces moistened with water or a weak solution of size, whereby any fluff on the yarns is laid or bound. The yarns thus defluffed are passed around a plurality of heated cylinders to be thereby dried and are, then, wound on a take-up beam in a winding section. Yarn spacing is maintained at at least 1.3 mm throughout the operation. Disclosed also is an apparatus specifically adapted for carrying out the method.

11 Claims, 8 Drawing Figures

METHOD OF, AND APPARATUS FOR SIZING AND DRYING WARPS

This invention relates to improvements in the method of, and apparatus for sizing and drying spun yarns used as wraps.

In the sizing and drying of spun yarns used as warps, such as cotton, hempen or woolen yarns or blended spun yarns composed of any such natural fiber and a synthetic fiber, it has been usual practice to size and dry together a large number of yarns as required for weaving a single sheet of fabric and then wind them on a single loom beam. This method does, however, have a number of drawbacks. For example, because of their heavy density or closely spaced relationship, yarns tend to stick to one another due to mutual contact or become entangled with one another due to loss of proper alignment therebetween during the sizing and drying operation. This necessarily requires separation of yarns by a dividing rod and a comb in the winding section of the apparatus. Such separation of the yarns often causes yarn breakage, fluffing, size stripping or other undersirable results. Moreover, the mutual contact or entanglement of yarns does not permit satisfactory application of size onto the individual yarns or efficient and uniform drying of the size. Furthermore, yarns tend to become fluffy when they leave the surfaces of squeezing rollers in the sizing section after they are squeezed to expel excedd size. Additionally, when any broken yarn is joined into a single strand during the warping operation, it often becomes distorted and such yarns, together with other yarns not broken, are formed into a warp beam without rectification of such distortion. It is difficult to remove any such fluff or distortion from the yarns during the sizing and drying operation, and the yarns are wound on a loom beam in their still distorted or considerably fluffy condition. If such a loom beam is used for weaving on a loom, the efficiency of the weaving operation obviously becomes low. If it is attempted to deprive the yarns of any such distortion during the sizing and drying processes, the operation of the sizing and drying apparatus must be discontinued for that particular purpose over an appreciable length of time, with a resultant reduction in the operating efficiency.

For the reasons set forth above, it has heretofore been difficult to produce sized spun yarns of satisfactorily defect-free quality with a reasonably high efficiency.

It is, therefore, an object of this invention to provide an improved method of sizing and drying warps and an improved apparatus specifically adapted for carrying out that method, which method and apparatus permit efficient production of uniformly sized and dried warps having no fluff.

According to one aspect of this invention, there is provided a method of sizing and drying warps, including the steps of withdrawing a large number of spun yarns from a warp beam supported on a beam stand, so that the yarns advance together in close relationship in a plane at intervals of at least 1.3 mm; passing the yarns through a solution of size; squeezing the yarns at least twice; rubbing the yarns against rods and comb needles having surfaces moistened with water or a weak solution of size to lay any fluff raised on the yarns; passing the yarns around heated cylinders to dry the yarns; and winding the yarns on a take-up beam.

According to another aspect of this invention, there is provided an apparatus for sizing and drying warps, comprising a beam stand section; a sizing section; a defluffing section; a drying section; and a winding section, the beam stand, sizing, defluffing, drying and winding sections being disposed successively in this order in the direction of travel of the warps through the apparatus; the beam stand section including at least one beam stand adapted to support a warp beam thereon; the sizing section including yarn aligning means for arranging at intervals of at least 1.3 mm a large number of spun yarns withdrawn from the warp beam and lying in spaced relationship in a plane, and a sizing unit provided with means for squeezing the yarns at least twice; the defluffing section including at least a pair of defluffing rods adapted for rubbing against diametrically opposite surfaces of the yarns, yarn aligning means for maintaining the intervals of at least 1.3 mm and means provided above the defluffing rods and the last mentioned yarn aligning means for spraying water or a weak solution of size thereagainst; the drying section including a plurality of appropriately heated drying cylinders around which the yarns are passed to be thereby dried after they are defluffed; the winding section including yarn aligning means for maintaining the intervals of at least 1.3 mm and a winding device adapted to support a take-up beam thereon.

An important feature of this invention is that a large number of spun yarns withdrawn from at least one warp beam and arranged to form, as it were, a sheet of lie in a common place are maintained in mutally spaced relationship by a distance of at least 1.3 mm while they are being sized, defluffed, dried and wound on a beam. It has been found that when 40s-count (0.154 mm dia.) or thinner spun yarns are withdrawn from a warp beam and sized and dried in a warp sizing and drying apparatus, the mutual spacing of at least 1.3 mm between the yarns can prevent any contact between the yarns that, if they were less widely spaced from one another, might result from any spinning motion imparted to the yarns by their twist where they contact guide rollers or like means, or from swelling of the yarns when they are coated with size, or from any other causes. Consequently, this invention provides a perfect solution to the various problems inherent in the method known in the art, including incomplete application of size and uneven drying of the size which are attributed to contact between yarns, their distortion or other causes, and yarn breakage and fluffing caused by separation of mutually adhering yarns in the winding section of the apparatus, so that all the yarns can be uniformly sized and dired in their completely separated condition with a high efficiency.

Another important feature of this invention resides in the defluffing of yarns, immediately after they are sized, with defluffing rods and needles of combs both of which are adequately moistened with water or a weak size solution. Thus, any fluff that may develop on yarns when they leave the surfaces of squeezing rollers can be effectively bound or laid, so that it is possible to obtain sized and dried yarns of good quality having virtually no fluff. The term "defluff" as used herein should be understood as meaning "bind or lay fluff" on yarns.

The invention will not be described in further detail, merely by way of example, with reference to the accompanying drawings, in which.

Figure 1:
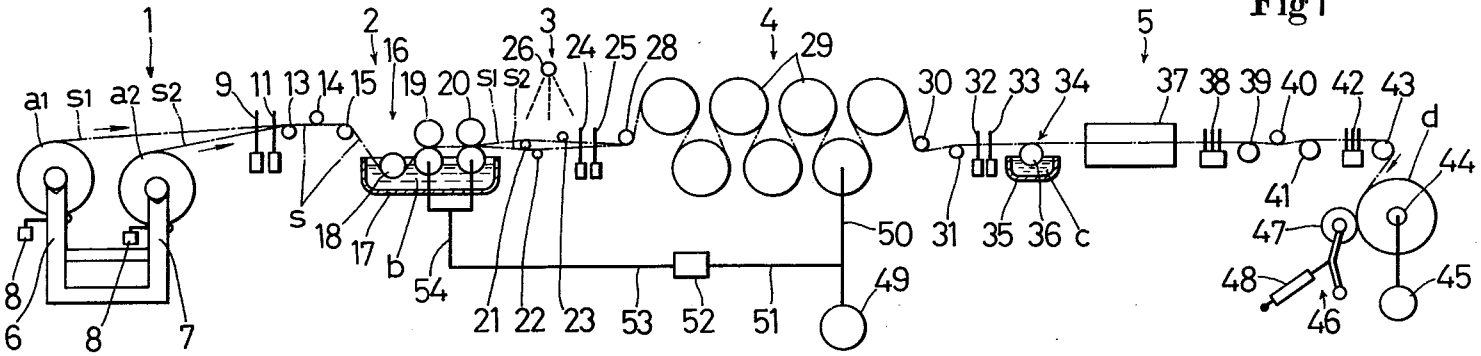
FIG. 1 is a schematic side elevational view showing an embodiment of the apparatus of this invention.

Referring now to FIG. 1 of the drawings, there is schematically illustrated an embodiment of the apparatus of this invention specifically adapted for sizing and drying spun yarns to be used as warps. The apparatus essentially comprises a beam stand section 1, a sizing section 2, a defluffing section 3, a drying section 4 and a winding section 5 which are arranged successively in this order in the direction of travel of yarns through the entire apparatus.

In the beam stand section 1, which is located in the rearmost portion of the apparatus or at the left-hand extremity of FIG. 1, there are provided a pair of beam strands 6 and 7 positioned one behind the other and at a somewhat higher level than the other. Each of the beam stands 6 and 7 is adapted to support a warp beam thereon and provided with a yarn tension controller 8.

Figure 2:
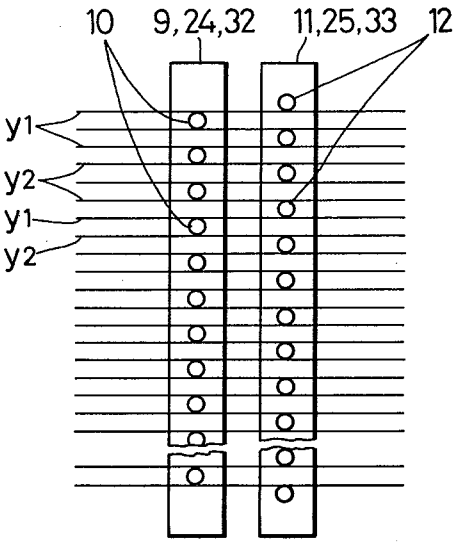
FIG. 2 is an enlarged plan view of each pair of combs having upright needles as used in the apparatus of FIG. 1.

The sizing section 2 includes a pair of combs 9 and 11 extending in spaced, parallel relationship transversely across the apparatus and each having a large number of upright needles 10 or 12 equally spaced from one another, while the distance between each adjoining pair of needles 10 is substantially equal to that between each adjoining pair of needles 12. The needles 10 and 12 of the combs 9 and 11, respectively, are so regularly staggered relative to each other that each needle of one comb is centrally aligned between one pair of adjoining needles of the other comb, except for the two needles 12 adjacent to the opposite ends of the comb 11, as shown in FIG. 2. The combs 9 and 11 are positioned in the rear (left-hand as viewed in FIG. 1) or inlet portion of the sizing section 2. The sizing section 2 further includes a guide roller 13, a tension roller 14 and another guide roller 15 arranged successively in this order ahead (or to the right in FIG. 1) of the comb 11. In the front end portion of the sizing section 2, there is provided a sizing unit 16 comprising a size vat 17 containing a size solution *b*, an immersion roller 18 substantially entirely immersed in the size solution *b* and a pair of size squeezers 19 and 20 each consisting of a pair of squeezing rollers which are supported one above the other and the lower of which is partly immersed in the size solution *b*.

Figure 3:
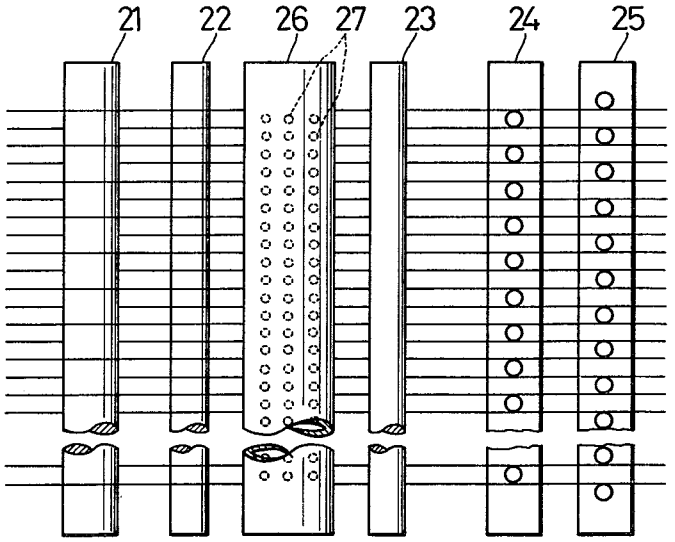
FIG. 3 is an enlarged plan view of the defluffing section of the apparatus shown in FIG. 1.

The defluffing section 3 includes three defluffing rods 21, 22 and 23 placed side by side in the direction of travel of yarns and at different levels of height. Provided beyond the frontmost defluffing rod 23 are a pair of combs 24 and 25 constructed and juxtaposed as described in connection with the combs 9 and 11 in the sizing section 2. The comb 24 has a large number of upright needles and the comb 25 likewise has a multiplicity of upright needles positioned in staggered or alternating relationship to those of the comb 24, exactly as described in connection with the combs 9 and 11 in the sizing section 2. A spray pipe 26 extending horizontally across the apparatus and having a bottom wall provided therethrough with a large number of spout openings 27 as illustrated in FIG. 3 is supported above the defluffing rods 21, 22 and 23 and the combs 24 and 25. The spray pipe 26 is piped to a supply of water or a weak size solution, though not shown in the drawings, and adapted to spray such water or a weak size solution onto the rods 21, 22 and 23 and the combs 24 and 25.

The drying section 4 includes a pair of guide rollers 28 and 30 provided across the apparatus at the inlet and outlet, respectively of the section and coated with Teflon (trademark) all around the surface thereof. Provided between the guide rollers 28 and 30 are a plurality of appropriately heated drying cylinders 29 coated with Teflon (trademark) all around the surface thereof and adapted for simultaneous rotation together. The drying cylinders 29 comprise an upper group of cylinders and a lower group of cylinders supported below the upper cylinders in alternate relationship thereto.

In the winding section 5 there are provided, in this order in the direction of travel of yarns, a guide roller 31, a pair of combs 32 and 33 each having a large number of upright needles, a waxing device 34, a cooling device 37, a comb 38 having a large number of upright needles formed in a zigzag fashion, a pair of guide rollers 39 and 41, a tension roller 40 located between the guide rollers 39 and 41 at a high level than them, a comb 42 of similar construction to the comb 38, a measuring roller 43, a winding device 44 and a press roller device 46 mounted behind the winding device 44. The combs 32 and 33 are identicl in construction to the combs 9 and 11, respectively, of the sizing section 2 as shown in FIG. 2, and are juxtaposed with their respective needles 10 and 12 arranged in mutually alternate relationship exactly as already described in connection with their counterparts in the sizing section. The waxing device 34 comprises a wax vat 35 containing molten wax *c* and a waxing roller 36 partly immersed in the wax *c*. The winding device 44 is provided with a driving motor 45 and adapted to support a take-up beam *d* thereon. The press roller device 46 includes a press roller 47 adapted for operation by a pneumatic cylinder 48 and having a peripheral surface to be urged against the peripheral surface of the mass of yarns wound on the take-up beam *d* supported on the winding device 44.

Additionally, the apparatus of FIG. 1 includes a yarn draft or stretch control device operationally associated with the squeezing rollers 19 and 20 and the drying cylinders 29. This device comprises a speed changing device 52 connected, on one side through a transmission shaft 51, to a driving shaft 50 for the drying cylinders 29 connected to an electric motor 49 at one end and one of the cylinders 29 at the other end, and on the other side through another transmission shaft 53 to a driving shaft 54 for the squeezing rollers 19 and 20.

Description will now be made, with reference to FIG. 1, of an embodiment of the method of this invention, in which the upright needles of each of the combs 9, 11, 24, 25, 32 and 33 have a diameter which is large enough to maintain a clearance of at least 1.3 mm between every two adjoining yarns, and are spaced from one another by a distance which is equal to at least twice as large as the sum of the needle and yarn diameters.

A pair of warp beams $a_1$ and $a_2$ each formed by a large number of spun yarns wound thereabout are mounted on the beam stands 6 and 7, respectively, positioned one behind the other and a take-up beam *d* is mounted on the winding device 44. The yarns are withdrawn from the warp beams $a_1$ and $a_2$ each to form an, as it were, sheet $S_1$ or $S_2$ of yarns lying in a common plane, and the leading end of each yarn is passed through the sizing section 2, the defluffing section 3 and the drying section 4 and fastened to the take-up beam *d*. The yarns $Y_1$ withdrawn from one warp beam $a_1$ and the yarns $Y_2$ from the other warp beam $a_2$ are combined, in the vicinity of the inlet to the sizing section 2, into a single group of yarns $Y_1$ and $Y_2$ lying in a common plane in equally spaced, alternating relationship. For this purpose, the yarns $Y_1$ and $Y_2$ are passed through the three pairs of combs 9 and 11, 24 and 25, and 32 and 33 in such a manner that each adjoining pair of yarns $Y_1$ and $Y_2$ extending through the clearance between one adjoining pair of upright needles on one of each pair of combs may be separated by, and lie on the opposite sides of, one upright needle on the other comb which is centrally aligned with the clearance between the one pair of needles on the one comb, as typically shown in FIG. 2. The apparatus is now ready for operation.

The electric motors 45 and 49 are placed in operation and water or a weak size solution is supplied to the spray pipe 26. The yarns withdrawn from the warp beams $a_1$ and $a_2$ in the from of the sheets $S_1$ and $S_2$, respectively, travel past the first pair of combs 9 and 11 and are combined in a single plane at the guide roller 13 immediately thereafter. When the yarns travel through the combs 9 and 11, any snarling and distortion that may have developed on the yarns during the warping operation are rectified and all the yarns withdrawn from the warp beams $a_1$ and $a_2$ are in their properly separated and straightened condition combined into a single group of yarns lying in the form of a single sheet S and spaced at least 1.3 mm from one another when they move past the upper surface of the guide roller 13. The yarns then travel past the lower surface of the tension roller 14 to the guide roller 15 which in turn guides the yarns downward into the size vat 17. When the yarns pass through the size solution *b* along the lower periphery of the immersion roller 18, each yarn is impregnated with size. Then, the yarns move forward to the two pairs of squeezing rollers 19 and 20 and are squeezed twice continuously to permit permeation of size through each yarn with no excess size left thereon prior to delivery to the defluffing section 3. Upon entry into the defluffing section 3, the yarns are separated by the first defluffing rod 21 into the initial two sheets or groups $S_1$ and $S_2$. The yarns of the first group $S_1$ travel past the upper surface of the first defluffing rod 21 and the lower surface of the third defluffing rod 23 without contacting the second or intermediate defluffing rod 22 in any way, while the yarns of the second group $S_2$ move past the lower surface of the first defluffing rod 21 and the upper surface of the second defluffing rod 22 without contacting the third defluffing rod 23. All the yarns then travel through the second pair of combs 24 and 25 for movement into the drying section 4. The peripheral surfaces of the defluffing rods 21, 22 and 23 and the needles of the combs 24 and 25 are moistened with water or a weak solution of size ejected from the spray pipe 26 as hereinbefore described. When the yarns move through the defluffing section 3, the upper and lower surfaces of the yarns are rubbed against the defluffing rods, while the opposite sides thereof are rubbed against the needles of the combs, whereby any fluff that may have been raised on the yarns when they leave the squeezing rollers 20 are effectively laid or bound. At the same time, any change in yarn spacing that may have taken place during their travel through the sizing and defluffing sections 2 and 3, is rectified by the combs 24 and 25 which permit the yarns to restore their initial, equally spaced relationship before they move forward into the drying section 4. As shown in FIG. 1, the two groups $S_1$ and $S_2$ of yarns move separately along their respective planar paths throughout the defluffing section 3, but at the inlet of the drying section 4, they are combined again into a single group of yarns lying in a common path as previously defined in the form of the sheet S when they travel past the lower periphery of the guide roller 28, while maintaining their mutual spacing of at least 1.3 mm. Then, the yarns travel in a zigzag fashion from one drying cylinder 29 to another and each yarn is dried through its contact with the hot surfaces of the drying cylinders 29. After their travel past the guide roller 30 at the outlet of the drying section 4, the yarns move pst the guide roller 31 into the winding section 5. They travel through the third pair of combs 32 and 33 and the upright needles of the combs 32 and 33 control the paths of the individual yarns to enable them to restore their mutual spacing of at least 1.3 mm which have been lost during their travel through the drying section 4. After they have left the comb 33, the yarns are brought into contact with the waxing roller 36 in the waxing device 34 and have their surfaces coated with wax. Then, they pass through the cooling device 37 and after they have been cooled there to an appropriate temperature, the yarns continue travel in a planar path through the comb 38, the guide roller 39, the tension roller 40, the guide roller 41 and the comb 42, while the tension roller 40 exerts an appropriate amount of downward pressure and cooperates with the guide rollers 39 and 41 to maintain proper tension on the yarns. Toward the outlet end of the winding section 5, the measuring roller 43 changes the direction of yarn travel so that the yarns then move downward. The yarns are would on the take-up beam *d*, while the press roller 47 maintains its adequate pressure contact with the outermost layer of the yarns wound on the take-up *d* to keep their winding density at optimum.

An optimum amount of tension or draft my be maintained on the yarns, at any point of their travel through the apparatus, by virtue of a combination of the functions of the tension controllers 8 associated with the beam stands 6 and 7 and the draft control device associated with the squeezing rollers 19 and 20 and the drying cylinders 29, and the rotational force of the take-up beam *d*. Thus, the yarns can maintain their mutual spacing of at least 1.3 mm without causing any snarling or entanglement between one another while they are being rewound, sized, dried and wound. Moreover, insofar as it is composed of twisted fibers, a spun yarn has an inherent tendency to spin in either direction about its axis when stretched, and when such a spinning yarn travels through the drying section 4, its frictional contact with the surface of each drying cylinder 29 causes the yarn to roll on the cylinder surface to some extend or other in either directions, so that the yarn leaving the drying section 4 has a desired circular cross section.

Figure 4:
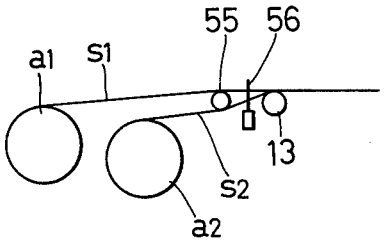
FIG. 4 is a fragmentary and schematic side elevational view illustrating a modification to the apparatus shown in FIG. 1.
Figure 5:
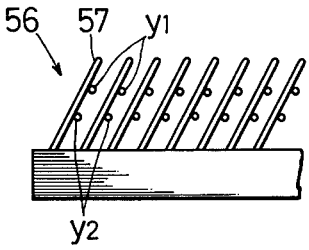
FIG. 5 is a fragmentary, enlarged front elevational view of the comb shown in FIG. 4.

FIGS. 4 and 5 fragmentarily illustrates a modification of the embodiment of this invention which has hereinabove described with reference to FIGS. 1 through 3 and which relies upon combs having upright needles to ensure proper alignment of yarns with their proper mutual spacing. According to the arrangement of FIGS. 4 and 5, each of the three pairs of combs having upright needles as shown in FIG. 1 may be replaced be a combination of a dividing rod 55 supported transversely across the apparatus and a comb 56 positioned in parallel to the dividing rod 55 and having a large number of slanting needles 57 extending upward from its base plate. The slanting needles 57 are inclined at an equal angle relative to the base plate of the comb 56 in a vertical plane transversely extending across the apparatus. As is clearly shown in FIG. 4, yarns are withdrawn from a pair of warp beams $a_1$ and $a_2$, respectively, in the form, as it were, of a pair of sheets $S_1$ and $S_2$ lying one above the other, and travel past the dividing rod 55 in such a manner that the yarns of the upper group $S_1$ are constantly in contact with the upper surface of the dividing rod 55, while those of the lower group $S_2$ maintain their constant contact with the lower surface of the dividing rod 55. Then, the yarns pass through the comb 56 in such a fashion that each pair of yarns, which consists of a yarn $Y_1$ of the upper group $S_1$ and a yarn $Y_2$ of the lower group $S_2$, travel in contact with one of the slanting needles 57 at different levels of height along the needle 57. As is also obvious from FIG. 5, each upper yarn $Y_1$ is centrally aligned between one pair of lower yarns $Y_2$ lying immediately therebelow.

Figure 6:
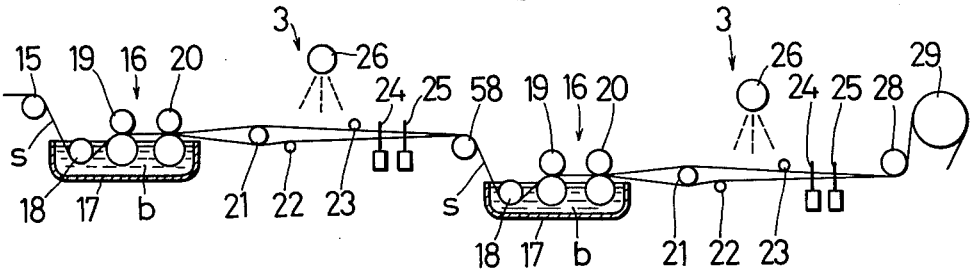
FIG. 6 is a schematic side elevational view illustrating another combination of the sizing unit and defluffing section of the apparatus shown in FIG. 1.

While the embodiment of FIG. 1 employs a single combination of a sizing unit 16 and a defluffing section 3, this arrangement may be modified in such a fashion that the apparatus includes a pair of such combinations located in series to each other with an additional guide roller 58 intervening therebetween as shown in FIG. 6.

Figure 7:
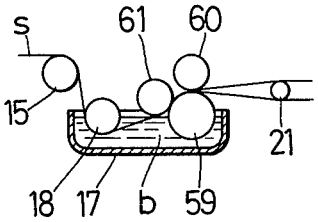
FIG. 7 is a schematic side elevational view showing a different form of the sizing unit illustrated in FIG. 1 or 6.

FIG. 7 illustrates a modification to the sizing unit 16 of FIG. 1 which includes two pairs of size squeezers 19 and 20 each consisting of a pair of squeezing rollers supported one on top of the other as already described. The modification relates to these squeezers and comprises a pair of squeezing rollers 59 and 60 which are similar to the squeezing rollers 20 of FIG. 1 or 6 in construction and positional arrangement, and a third squeezing roller 61 placed behind the rollers 59 and 60 and contacting the lower thereof. It will be noted that according to this modified arrangement, yarns first travel between the rollers 59 and 61 and then between the rollers 59 and 60, whereby they are squeezed twice as done by the sizing unit 16 of FIG. 1.

Figure 8:
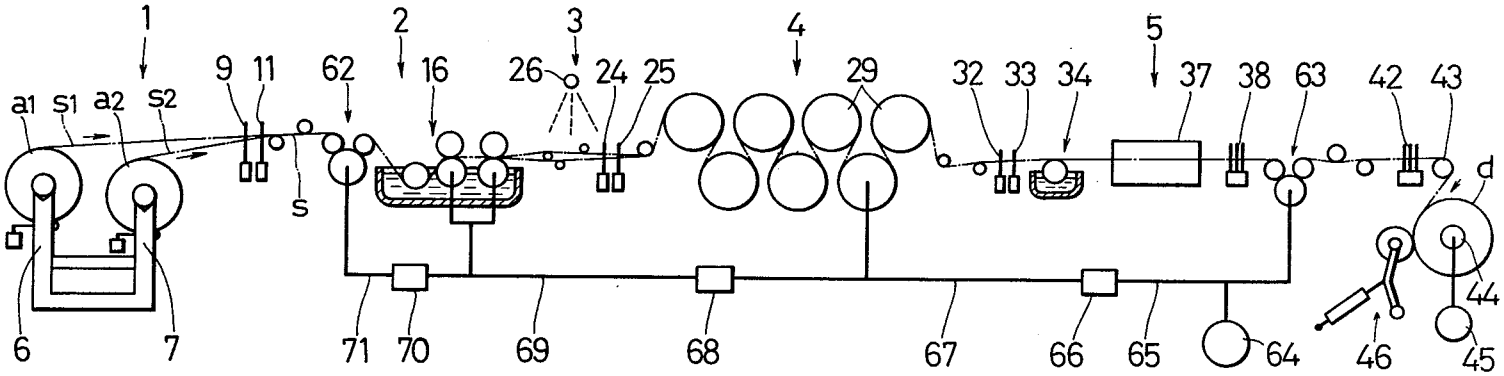
FIG. 8 is a schematic side elevational view showing another embodiment of the apparatus of this invention.

FIG. 8 illustrates another embodiment of the apparatus of this invention and more specifically, it shows a modification to the draft control device employed in the apparatus of FIG. 1. The arrangement of FIG. 8 includes a first carrier roller device 62 and a second carrier roller device 63 provided in place of the guide rollers 15 and 39, respectively, in FIG. 1. The second carrier roller device 63 is provided with a driving shaft connected to one end of a first transmission shaft 65 adapted to be driven by an electric motor 64. The other end of the first transmission shaft 65 is connected to a first speed changer 66 to which a second transmission shaft 67 is connected at one end. A driving shaft connected at one end to one of drying cylinders 29 for synchronized rotation of all of the drying cylinders 29 is connected at the other end to the second transmission shaft 67 intermediate the ends thereof. The other end of the second transmission shaft 67 is connected to a speed changer 68 to which a third transmission shaft 69 is connected at one end. A driving shaft for squeezing rollers is connected to the third transmission shaft 69 intermediate the ends thereof. The other end of the third transmission shaft 69 is connected to a third speed changer 70 to which a fourth transmission shaft 71 is connected at one end while the other end of the last mentioned shaft is connected to a driving shaft for the first carrier roller device 62. In any other respects, the structural and operational features of the apparatus shown in FIG. 8 are substantially identical to those already described with reference to FIG. 1. Thus, no further description will be necessary to those skilled in the art, as like numerals indicate like parts both in FIGS. 1 and 8, as well as in any other figures of the drawings.

While the invention has hereinabove been described and shown to employ a pair of warp beams $a_1$ and $a_2$ from which yarns are withdrawn, sized, dired and wound on a single take-up beam $d$ with their mutual spacing maintained at at least 1.3 mm, it will be obvious that this invention may equally be applicable to size and dry yarns withdrawn from a single warp beam.

Thus, this invention essentially consists in the sizing and drying of spun yarns withdrawn from a warp beam or beams in the form, as it were, of a sheet of sheets, wherein yarn spacing is maintained no narrower than 1.3 mm to keep the yarns free from any adhesion or entanglement throughout the sizing and drying operation, the yarns are squeezed at least twice during the sizing operation and the yarns thus sized and squeezed are dried by a plurality of heated cylinders after they are defluffed. Therefore, it will be understood that this invention permits efficient production of high quality sized and dried spun yarns having no fluff raised thereon and having a desired circular cross section.

It will readily be noted that a number of take-up beams on which yarns prepared according to this invention are wound will be transformed by a rewinding machine into a single loom beam, through the exact number of the take-up beams to be used may depend on the number of the warps required to weave a single sheet of particular fabric.

The following table illustrates a specific example of principal technical data found useful for putting this invention into practice:

| | |
|---|---|
| Type of yarns treated | 40s-count single cotton yarns |
| Number of yarns wound on one warp beam | 508 |
| Effective warp beam length | 1.627 mm |
| Number of warp beams used | 2 |
| Total number of yarns treated | 1,016 |
| Effective take-up beam length | 1.627 mm |
| Diameter of each upright comb needle | 1.2 mm |
| Upright comb needle spacing | 3.0 mm |

Although the invention has been described and shown with reference to a few preferred embodiments, thereof, it is to be understood that further modifications or variations may be made by anybody of ordinary skill in the art to the specific structures, methods, data and other particulars as herein disclosed, without departing from the scope of this invention which is defined only by the appended claims.

What is claimed is:

1. A method of sizing and drying warps, including the steps of:

withdrawing a large number of spun yarns from a warp beam supported on a beam stand, so that said yarns advance together in a plane in mutually contiguous, but spaced relationship at intervals of at least 1.3 mm;

passing said yarns through a solution of size;

squeezing said yarns at least twice;

rubbing said yarns, subsequent to the final squeezing thereof, against rods and comb needles having surfaces moistened with water or a weak solution of size to lay any fluff raised on said yarns by the squeezing thereof;

passing said yarns around heated cylinders to dry said yarns; and winding said yarns on a take-up beam.

2. An apparatus for sizing and drying warps, comprising:

a beam stand section;

a sizing section;

a defluffing section;

a drying section; and a winding section, said beam stand, sizing, defluffing, drying and winding sections being disposed successively in this order in the direction of travel of said warps through said apparatus;

said beam stand section including at least one beam stand adapted to support a warp beam thereon;

said sizing section including yarn aligning means for arranging at intervals of at least 1.3 mm a large number of spun yarns withdrawn from said warp beam and lying in spaced relationship in a plane, and a sizing unit provided with means for squeezing said yarns at least twice;

said defluffing section including at least a pair of defluffing rods adapted for rubbing against diametrically opposite surfaces of said yarns, yarn aligning means for maintaining said intervals of at least 1.3 mm and means provided above said defluffing rods and said last mentioned yarn aligning means for spraying water or a weak solution of size thereagainst;

said drying section including a plurality of appropriately heated drying cylinders around which said yarns are passed to be thereby dried after they are defluffed;

said winding section including yarn aligning means for maintaining said intervals of at least 1.3 mm and a winding device adapted to support a take-up beam thereon.

3. An apparatus as defined in claim 2 wherein said beam stand section comprises a pair of beam stands each adapted to support a warp beam thereon in such a fashion that said warp beam supported on one of said beam stands is adapted to deliver a first group of yarns in a plane of higher level than a second group of yarns to be delivered by said warp beam on the other of said beam stands.

4. An apparatus as defined in claim 3 wherein each of said yarn aligning means in said sizing, defluffing and winding sections comprises a large number of comb needles disposed in a pair of rows extending transversely across said apparatus, each of said needles in one of said rows being centrally aligned between one adjacent pair of said needles in the other of said rows.

5. An apparatus as defined in claim 3 wherein each of said yarn aligning means in said sizing, defluffing and winding sections comprises a dividing rod having upper and lower surfaces adapted to be maintained in constant contact, respectively, with said first and second groups of yarns, and a comb having a large number of slanting needles adapted to be contracted by said first and second groups of yarns and position said first group of yarns relative to said second group of yarns in such a manner that each of said first group of yarns is spaced above and centrally aligned between one adjacent pair of said second group of yarns.

6. An apparatus as defined in claim 2 wherein each of said drying cylinders has a Teflon surface coating and said drying section further includes a guide roller having a Teflon surface coating and adapted to deliver said yarns to said drying cylinders.

7. An apparatus as defined in claim 2 wherein said sizing unit comprises a size vat containing a solution of size, an immersion roller partly immersed in said solution, and said squeezing means comprising two pairs of squeezing rollers spaced from each other in said direction of travel, each of said pairs consisting of an upper and a lower roller, said lower rollers being partly immersed in said solution of size.

8. An apparatus as defined in claim 2 wherein said sizing unit comprises a size vat containing a solution of size, an immersion roller partly immersed in said solution, and said squeezing means consisting of a pair of squeezing rollers placed one on top of the other and a third squeezing roller spaced from said one squeezing roller in said direction of travel and contacting said other squeezing roller.

9. An apparatus as defined in claim 2, further including a second sizing unit and a second defluffing section provided in series to said first mentioned sizing unit and defluffing section.

10. An apparatus as defined in claim 2, further including a yarn draft control device which comprises a speed changer, a first transmission shaft connected at one end to one end of said speed changer, while the other end of said first transmission shaft is connected to a driving shaft for said drying cylinders leading to an electric motor, and a second transmission shaft connected at one end to the other end of said speed changer, the other end of said second transmission shaft being connected to a driving shaft for said squeezing means.

11. An apparatus as defined in claim 2, further including a yarn draft control device which comprises a first carrier roller device provided in said sizing section and having a driving shaft, a second carrier roller device provided in said winding section and having a driving shaft connected to an electric motor, a first speed changer having one end connected by a first transmission shaft to said driving shaft for said second carrier roller device, while the other end of said first speed changer is connected to a driving shaft for said drying cylinders by a second transmission shaft, a second speed changer having one end connected by said second transmission shaft to said driving shaft for said drying cylinders, while the other end of said second speed changer is connected to a driving shaft for said squeezing means by a third transmission shaft, and a third speed changer having one end connected by said third transmission shaft to said driving shaft for said squeezing means, while the other end of said third speed changer is connected to said driving shaft for said first carrier roller device by a fourth transmission shaft.

* * * * *